US010581196B2

(12) United States Patent
Liu et al.

(10) Patent No.: US 10,581,196 B2
(45) Date of Patent: Mar. 3, 2020

(54) POWER CONNECTOR AND CONNECTOR ASSEMBLY

(71) Applicant: Tyco Electronics (Shanghai) Co. Ltd., Shanghai (CN)

(72) Inventors: Jiaoyong Liu, Shanghai (CN); Guangming Zhao, Shanghai (CN); Hua Li, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 16/130,143

(22) Filed: Sep. 13, 2018

(65) Prior Publication Data

US 2019/0089093 A1 Mar. 21, 2019

(30) Foreign Application Priority Data

Sep. 15, 2017 (CN) ..... 2017 1 0831981

(51) Int. Cl.
*H01R 13/62* (2006.01)
*H01R 13/621* (2006.01)
(Continued)

(52) U.S. Cl.
CPC ..... *H01R 13/6215* (2013.01); *H01R 4/46* (2013.01); *H01R 9/223* (2013.01); *H01R 12/7088* (2013.01); *H01R 13/187* (2013.01); *H01R 25/162* (2013.01); *H01R 13/26* (2013.01); *H01R 2103/00* (2013.01)

(58) Field of Classification Search
CPC ..... H01R 25/162; H01R 12/7088
See application file for complete search history.

(56) References Cited

U.S. PATENT DOCUMENTS 7,011,548 B2 * 3/2006 Bogiel ..... H01R 12/727 439/247
7,581,972 B2 9/2009 Daamen
(Continued)

FOREIGN PATENT DOCUMENTS

CN 101369719 B 5/2012
CN 203250889 U 10/2013
CN 206640005 U 11/2017

OTHER PUBLICATIONS

Abstract of CN 203250889, dated Oct. 23, 2013, 1 page.
Abstract of CN 206640005, dated Nov. 14, 2017, 1 page.

*Primary Examiner* — Ross N Gushi
(74) *Attorney, Agent, or Firm* — Barley Snyder

(57) ABSTRACT

A power connector comprises an insulation body having a slot at a first side of the insulation body and a plurality of conductive terminals disposed in the insulation body. The conductive terminals include a positive conductive terminal and a negative conductive terminal. A first end of the positive conductive terminal is disposed in the slot and electrically contacts a first positive bus bar of a bus bar plug assembly inserted into the slot, and a second end of the positive conductive terminal electrically connects with a second positive bus bar. A first end of the negative conductive terminal is disposed in the slot and electrically contacts a first negative bus bar of the bus bar plug assembly, and a second end of the negative conductive terminal electrically connects with a second negative bus bar separated from the second positive bus bar.

16 Claims, 8 Drawing Sheets

(51) Int. Cl.

| | |
|---|---|
| ***H01R 25/16*** | (2006.01) |
| ***H01R 12/70*** | (2011.01) |
| ***H01R 9/22*** | (2006.01) |
| ***H01R 13/187*** | (2006.01) |
| ***H01R 4/46*** | (2006.01) |
| *H01R 13/26* | (2006.01) |
| *H01R 103/00* | (2006.01) |

(56) References Cited

U.S. PATENT DOCUMENTS

| | | | | |
|---|---|---|---|---|
| 7,666,025 | B2 * | 2/2010 | Cheng | H01R 12/7088 439/374 |
| 8,043,097 | B2 * | 10/2011 | Ngo | H01R 12/7088 439/206 |
| 8,257,102 | B2 * | 9/2012 | Delgado | H01R 24/58 257/177 |
| 8,926,375 | B2 * | 1/2015 | Chen | H01R 12/7088 439/682 |
| 9,257,804 | B1 * | 2/2016 | Beck | H01R 25/142 |
| 9,531,102 | B2 * | 12/2016 | Chen | H01R 13/42 |
| 9,537,242 | B2 * | 1/2017 | Chen | H01R 13/18 |
| 9,595,962 | B1 * | 3/2017 | Beck | H01H 35/00 |
| 9,735,526 | B1 * | 8/2017 | Chen | H01R 13/11 |
| 9,742,133 | B1 * | 8/2017 | Chen | H01R 12/7088 |
| 9,882,321 | B1 * | 1/2018 | Hibbs | H01R 24/60 |
| 10,096,920 | B2 * | 10/2018 | Lee | H01R 13/4226 |
| 2006/0128197 | A1 * | 6/2006 | McGowan | H01R 12/58 439/212 |
| 2013/0065414 | A1 * | 3/2013 | Yu | H01R 12/716 439/206 |
| 2018/0316162 | A1 * | 11/2018 | Deshayes | H01R 12/7088 |
| 2018/0322983 | A1 * | 11/2018 | Satou | H01B 5/02 |

* cited by examiner

POWER CONNECTOR AND CONNECTOR ASSEMBLY

CROSS-REFERENCE TO RELATED APPLICATION

This application claims the benefit of the filing date under 35 U.S.C. § 119(a)-(d) of Chinese Patent Application No. 201710831981.8, filed on Sep. 15, 2017, the whole disclosure of which is incorporated herein by reference.

FIELD OF THE INVENTION

The present invention relates to a power connector and, more particularly, to a power connector including a positive conductive terminal and a negative conductive terminal.

BACKGROUND

A power connector, as is known in the art, includes an insulation body and a positive conductive terminal and a negative conductive terminal disposed in the insulation body. The positive conductive terminal and the negative conductive terminal are adapted to respectively electrically contact a positive bus bar and a negative bus bar inserted into the power connector. Each side of the known power connector, however, can only be connected with two separate bus bars, which limits the application of the power connector.

An electric arc commonly occurs between the positive conductive terminal and the positive bus bar or between the negative conductive terminal and the negative bus bar during live plugging or unplugging of the bus bars. If the supply voltage is high, the high voltage electric arc may burn and destroy the positive and negative conductive terminals, and in severe cases may lead to the thermal melting of the positive and negative conductive terminals. Once the positive and negative conductive terminals are thermally molten, the positive and the negative conductive terminals will be fused to the positive and negative bus bars, respectively, which seriously affects the safety and performance of the power connector.

SUMMARY

A power connector comprises an insulation body having a slot at a first side of the insulation body and a plurality of conductive terminals disposed in the insulation body. The conductive terminals include a positive conductive terminal and a negative conductive terminal. A first end of the positive conductive terminal is disposed in the slot and electrically contacts a first positive bus bar of a bus bar plug assembly inserted into the slot, and a second end of the positive conductive terminal electrically connects with a second positive bus bar. A first end of the negative conductive terminal is disposed in the slot and electrically contacts a first negative bus bar of the bus bar plug assembly, and a second end of the negative conductive terminal electrically connects with a second negative bus bar separated from the second positive bus bar.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
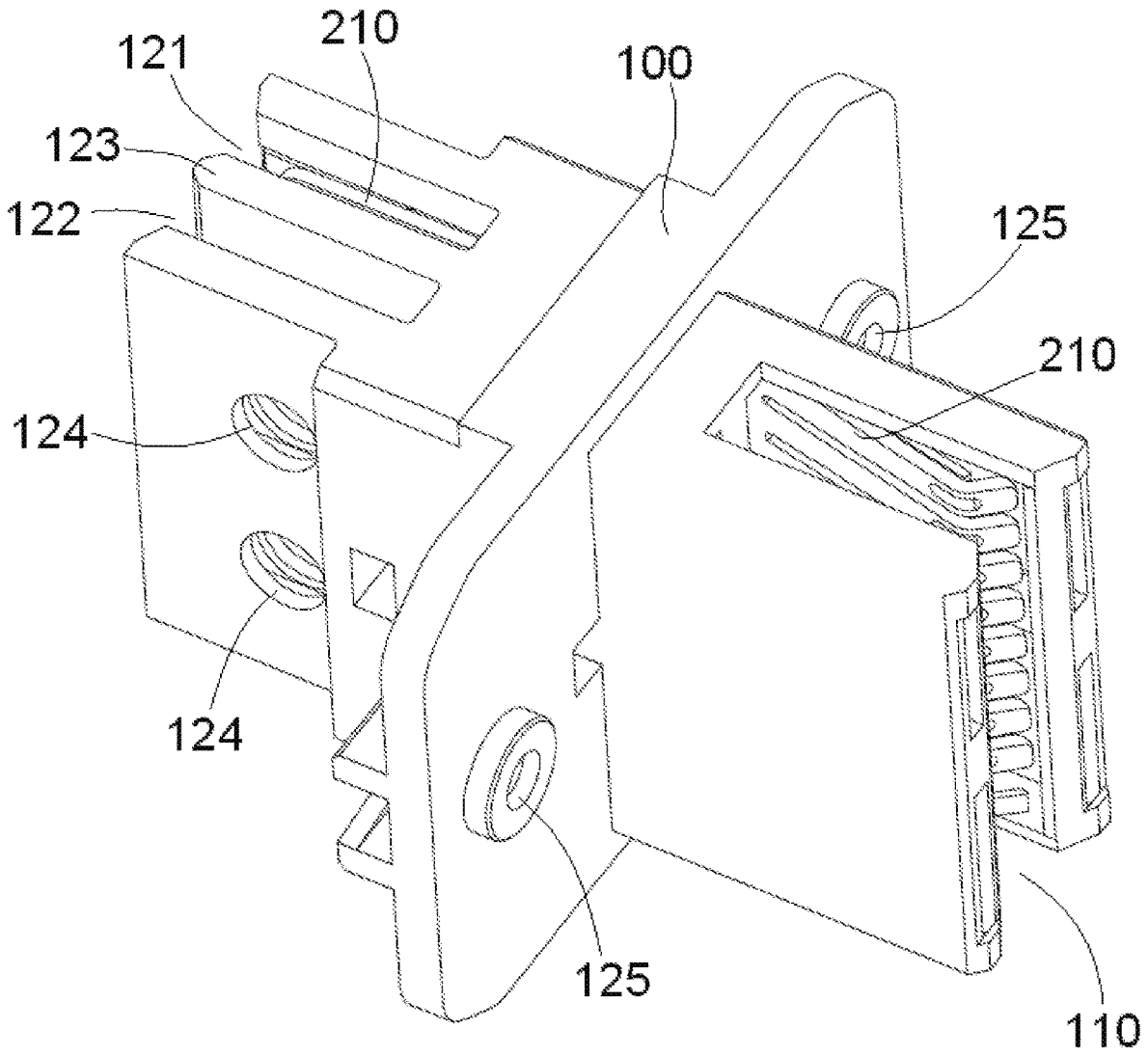
FIG. 1 is a perspective view of a power connector according to an embodiment.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete and will fully convey the concept of the invention to those skilled in the art.

A power connector according to an embodiment, as shown in FIGS. 1-4, comprises an insulation body 100, a plurality of conductive terminals 210, 220, and a detection terminal 230. The insulation body 100 is formed with a slot 110 at a first side of the insulation body 100. The conductive terminals 210, 220 are provided in the insulation body 100. The conductive terminals 210, 220 each have a conductive contact point 211, 221 on a first end thereof. The conductive contact points 211, 221 of the conductive terminals 210, 220 are adapted to electrically contact a bus bar plug assembly 10 inserted into the slot 110. A connector assembly comprises the power connector and the bus bar plug assembly 10 adapted to be inserted into the slot 110 of the power connector.

The detection terminal 230, as shown in FIGS. 1-4, is disposed in the insulation body 100. The detection terminal 230 is formed with a detection contact point 231 on a first end thereof. The detection contact point 231 of the detection terminal 230 is adapted to electrically contact the bus bar plug assembly 10 inserted into the slot 110.

As shown in FIGS. 1-4, the detection contact point 231 of the detection terminal 230 is located behind the contact points 211, 212 of the conductive terminals 210, 220. Thereby, during insertion of the bus bar plug assembly 10 into the slot 110, the detection terminal 230 electrically contacts the bus bar plug assembly 10 only after the conductive terminals 210, 220 electrically contact the bus bar plug assembly 10. During pulling out of the bus bar plug assembly 10 from the slot 110, the detection terminal 230 is electrically disconnected from the bus bar plug assembly 10 before the conductive terminals 210, 220 are electrically disconnected from the bus bar plug assembly 10. Thereby, it is possible to control a power supply system according to the electrical connection status of the detection terminal 230 to prevent an electric arc from occurring between the conductive terminals 210, 220 and the bus bar plug assembly 10.

During insertion of the bus bar plug assembly 10 into the power connector, the power supply system supplies power to the bus bar plug assembly 10 only after the detection terminal 230 is in electrical contact with the bus bar plug assembly 10. Because the conductive terminals 210, 220 are already in electrical contact with the bus bar plug assembly 10 before the power supply system supplies power to the bus bar plug assembly 10, no electric arc occurs between the conductive terminals 210, 220 and the bus bar plug assembly 10. On the other hand, during pulling out the bus bar plug assembly 10 from the power connector, the power supply system stops supplying power to the bus bar plug assembly 10 immediately after the detection terminal 230 is electrically disconnected from the bus bar plug assembly 10. Because the conductive terminals 210, 220 are still in electrical contact with the bus bar plug assembly 10 when the power supply system stops supplying power to the bus bar plug assembly 10, no electric arc occurs between the conductive terminals 210, 220 and the bus bar plug assembly 10. In this way, the power connector effectively prevents an electric arc from occurring between the conductive terminals 210, 220 and the bus bar plug assembly 10 during insertion or pulling out of the bus bar plug assembly 10, improving the safety of the power connector.

The conductive terminals 210, 220, as shown in FIGS. 1-4, include a positive conductive terminal 210 and a negative conductive terminal 220 disposed in the insulation body 100. The first ends of the positive conductive terminal 210 and the negative conductive terminal 220 are located in the slot 110 and are respectively adapted to electrically contact a first positive bus bar 11 and a first negative bus bar 12 of the bus bar plug assembly 10 inserted into the slot 110.

Figure 6:
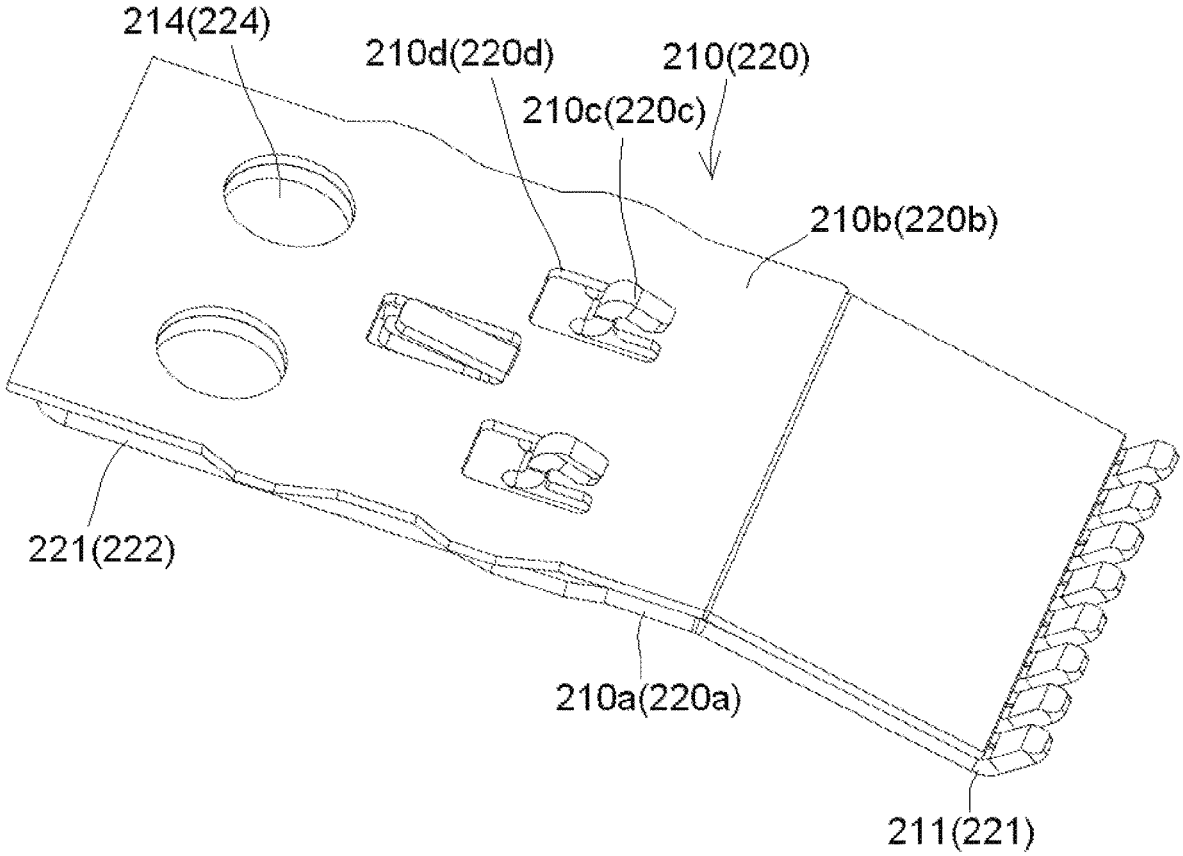
FIG. 6 is a perspective view of the conductive terminals of the power connector.

The conductive terminals 210, 220 are shown in FIG. 6. The positive conductive terminal 210 and the negative conductive terminal 220 each include an inner metal plate 210*a*, 220*a* and an outer metal plate 210*b*, 220*b* laminated on the inner metal plate 210*a*, 220*a*. The inner metal plate 210*a*, 220*a* has a greater conductivity than the outer metal plate 210*b*, 220*b*, and a mechanical property, for example, rigidness and/or wear resistance, of the outer metal plate 210*b*, 220*b* is higher that of the inner metal plate 210*a*, 220*a*. In an embodiment, the inner metal plate 210*a*, 220*a* is made of copper and the outer metal plate 210*b*, 220*b* is made of stainless steel. As shown in the embodiment of FIG. 6, the inner metal plate 210*a*, 220*a* and the outer metal plate 210*b*, 220*b* are locked to each other. A slot 210*d*, 220*d* is formed in the outer metal plate 210*b*, 220*b*, and an elastic latch 210*c*, 220*c* is formed on the inner metal plate 210*a*, 220*a*. The elastic latch 210*c*, 220*c* is locked into the slot 210*d*, 220*d* of the outer metal plate 210*b*, 220*b*, so as to lock the inner metal plate 210*a*, 220*a* and the outer metal plate 210*b*, 220*b* together.

The power connector, as shown in FIGS. 1-4, further comprises an electrical connection member 233 adapted to electrically connect a second end 232 of the detection terminal 230 to a wire in a pluggable manner.

The insulation body 100, as shown in FIGS. 1-4, includes a connection hole 125. The insulation body 100 is adapted to be connected to an installation panel 1, such as a case of an electric apparatus, by a screw 126 passing through the connection hole 125 and screwed into a thread hole formed in the installation panel 1.

Figure 2:
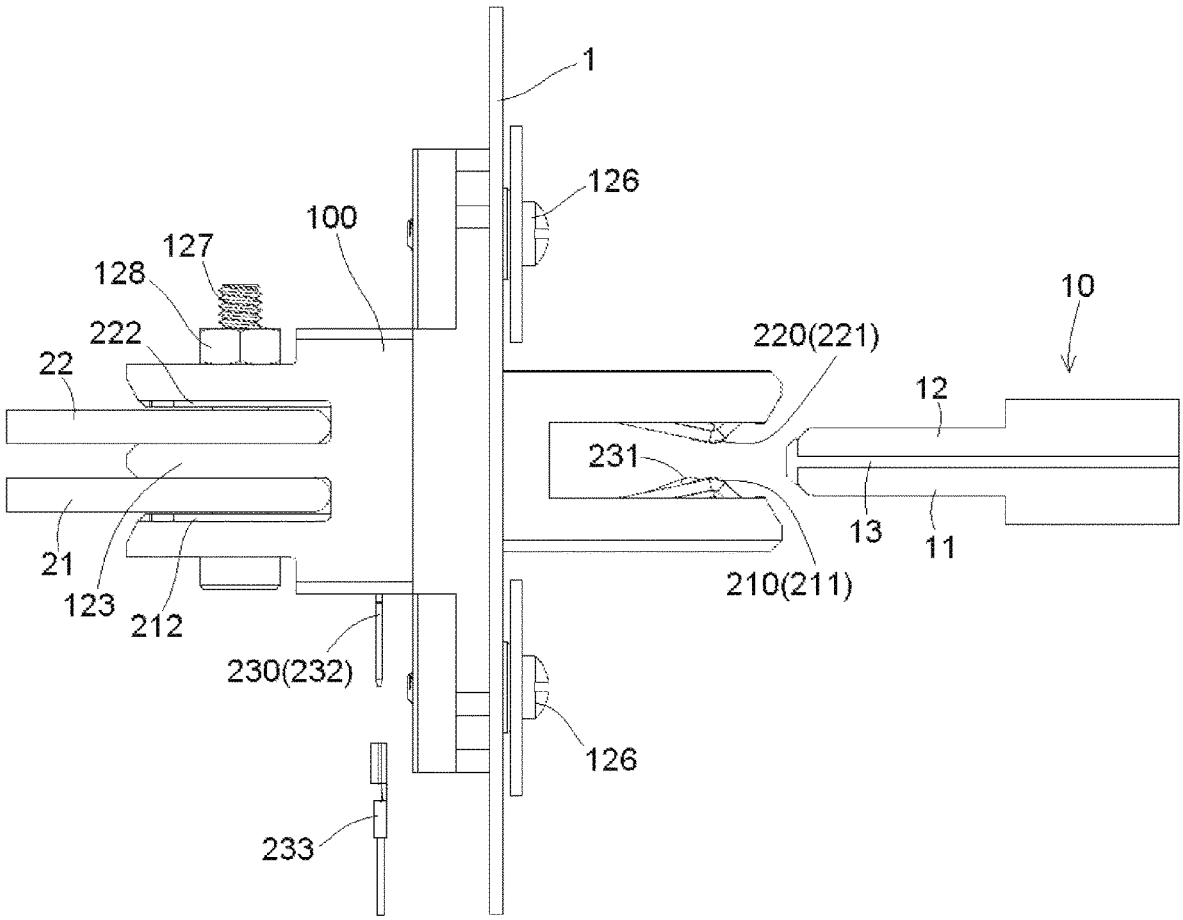
FIG. 2 is a side view of the power connector.
Figure 3:
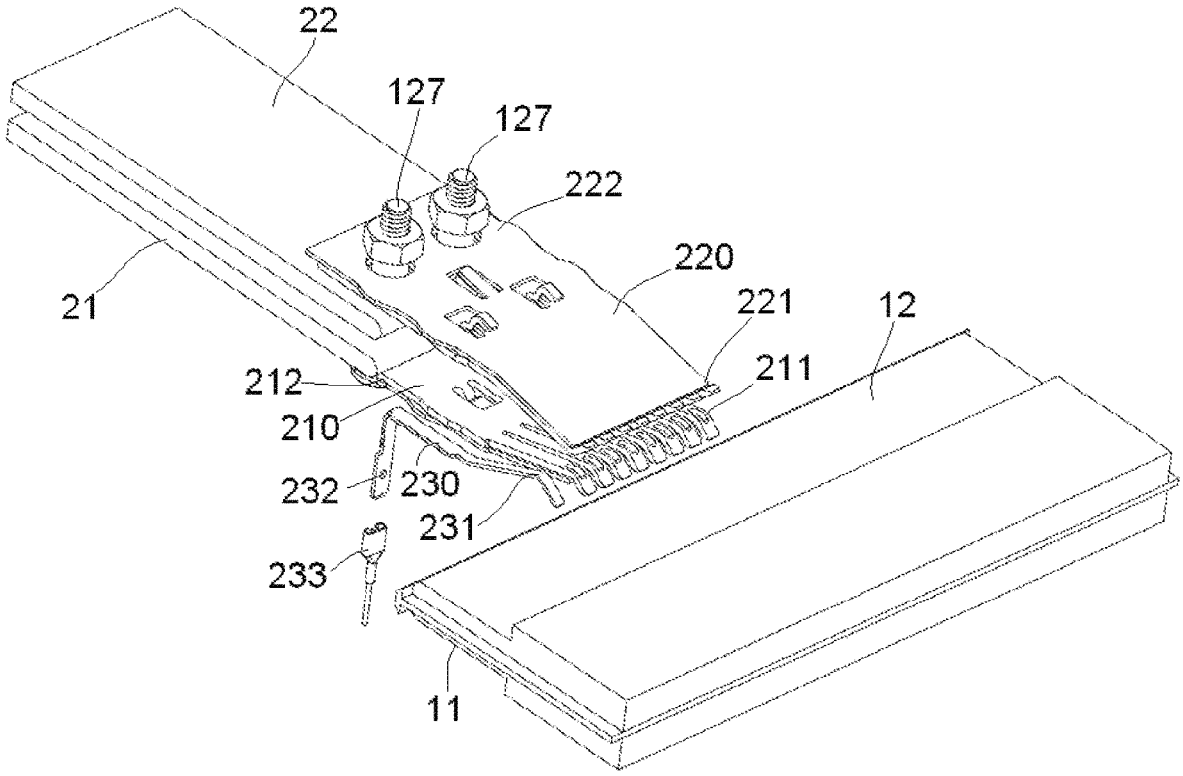
FIG. 3 is a perspective view of a plurality of conductive terminals and a detection terminal of the power connector with bus bars and a bus bar plug assembly.
Figure 4:
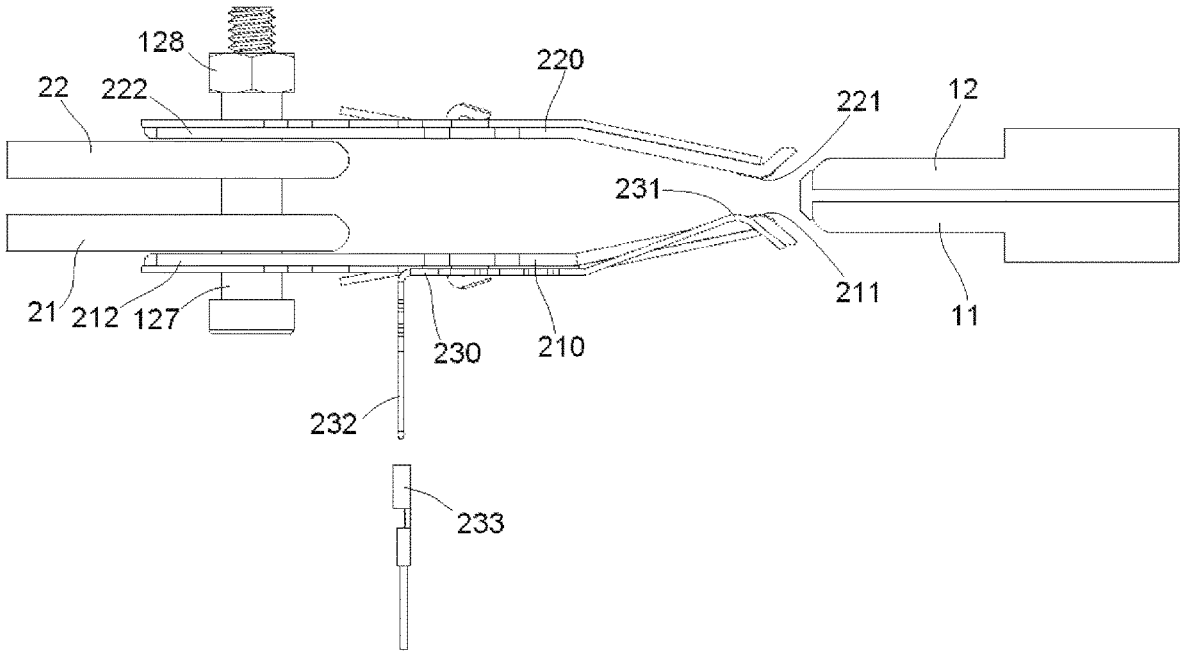
FIG. 4 is a side view of the conductive terminals and the detection terminal of the power connector with the bus bars and the bus bar plug assembly.
Figure 5:
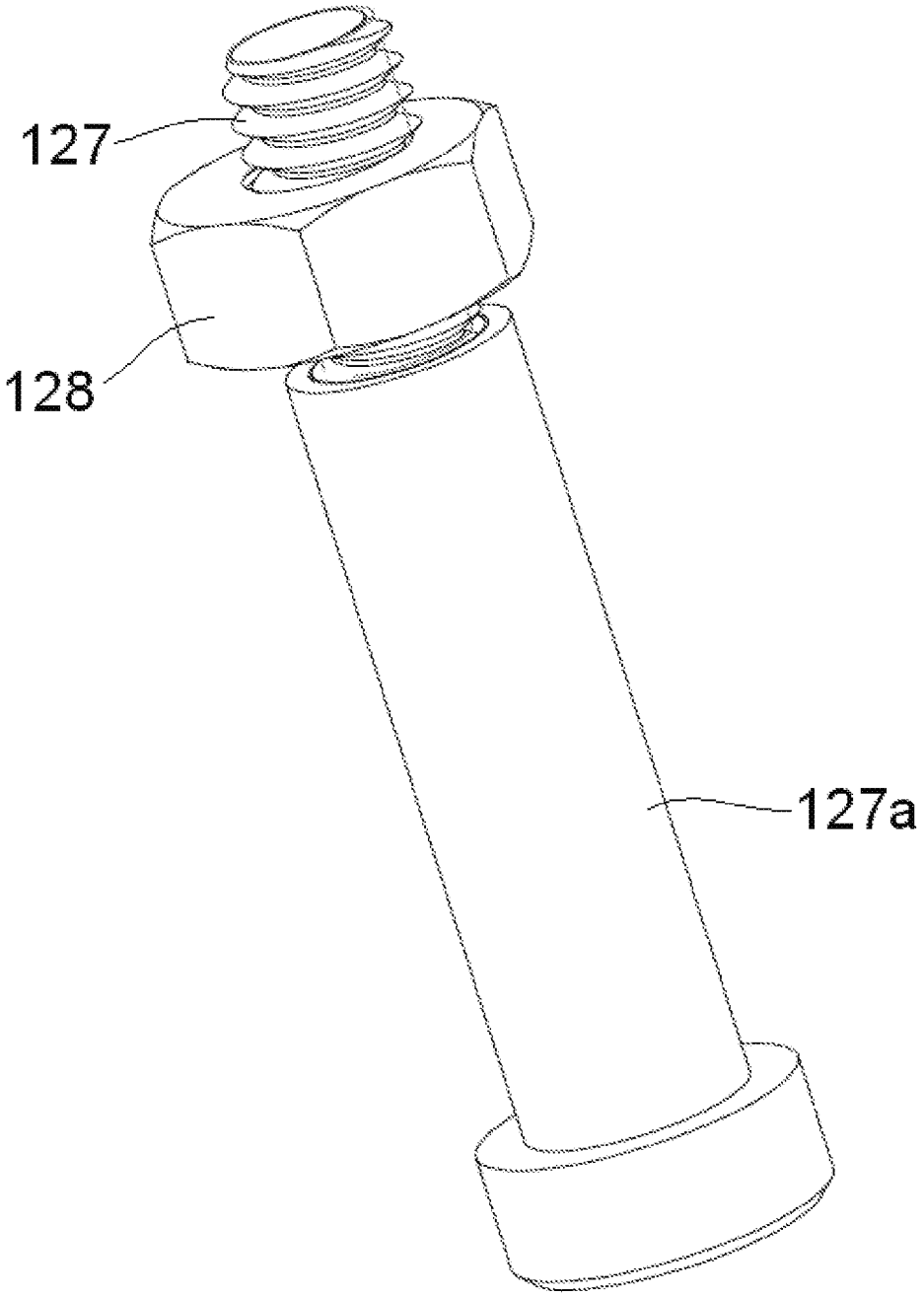
FIG. 5 is a perspective view of a thread connection assembly of the power connector.

The bus bar plug assembly 10, as shown in FIGS. 2-4, includes the first positive bus bar 11, the first negative bus bar 12, and an electrical isolation layer 13 provided between the first positive bus bar 11 and the first negative bus bar 12. The first positive bus bar 11 is adapted to electrically contact the positive conductive terminal 210. The first negative bus bar 12 is adapted to electrically contact the negative conductive terminal 220. The electrical isolation layer 13 is configured to electrically isolate the first positive bus bar 11 from the first negative bus bar 12. The detection contact point 231 of the detection terminal 230 is adapted to electrically contact the first positive bus bar 11 or the first negative bus bar 12 of the bus bar plug assembly 10.

The connector assembly, as shown in FIGS. 1-4, comprises the second positive bus bar 21 and the second negative bus bar 22. The second positive bus bar 21 and the second negative bus bar 22 are load side bus bars electrically connected to the electric apparatus. The first positive bus bar 11 and the first negative bus bar 12 are power side bus bars electrically connected to the power supply. The second positive bus bar 21 is adapted to be electrically connected to the second end 212 of the positive conductive terminal 210 and the second negative bus bar 22 is adapted to be electrically connected to the second end 222 of the negative conductive terminal 220.

As shown in FIGS. 2-5, the second positive bus bar 21 and the second negative bus bar 22 are adapted to be electrically connected to the positive conductive terminal 210 and the negative conductive terminal 220, respectively, by a thread connection assembly 127, 128. The thread connection assembly 127, 128 includes a bolt 127 and a nut 128. The bolt 127 passes through holes 214, 224, 124 formed in the second positive bus bar 21, the second negative bus bar 22, the positive conductive terminal 210, the negative conductive terminal 220 and the insulation body 100. The nut 128 is screwed onto an end of the bolt 127. An insulation coating layer 127*a* is formed on the bolt 127 to prevent the positive conductive terminal 210 from being electrically connected to the negative conductive terminal 220 by the bolt 127. In another embodiment, an insulation tube may be sleeved onto the bolt 127 to prevent the positive conductive terminal 210 from being electrically connected to the negative conductive terminal 220 by the bolt 127.

The insulation body 100 has a first receiving slot 121 and a second receiving slot 122 at a second side of the insulation body 100 opposite the first side having the slot 110, and the first receiving slot 121 and the second receiving slot 122 are separated from each other by a middle partition wall 123 formed on the insulation body 100. The second end 212 of the positive conductive terminal 210 is received in the first receiving slot 121, and the second end 222 of the negative conductive terminal 220 is received in the second receiving slot 122.

Figure 7:
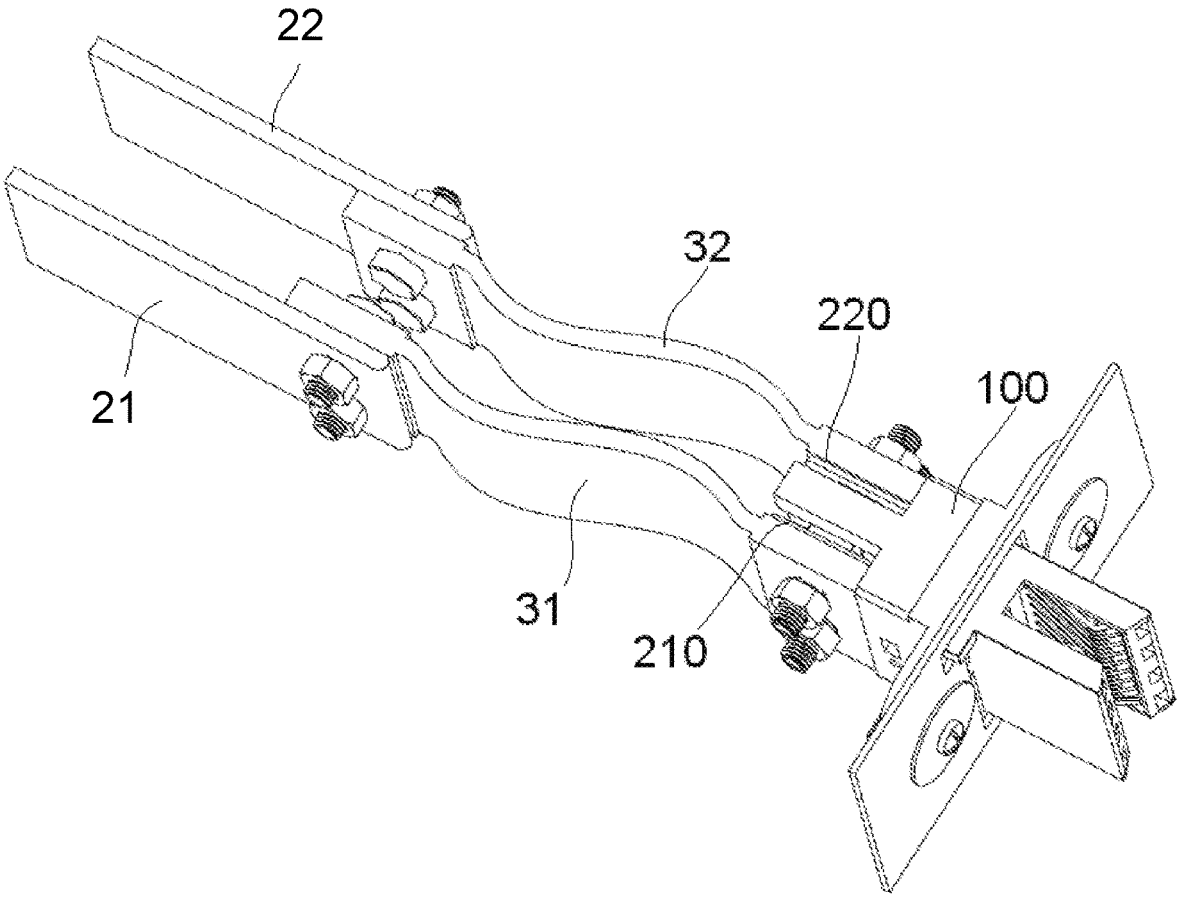
FIG. 7 is a perspective view of a plurality of flexible connection members connecting the conductive terminals to the bus bars.
Figure 8:
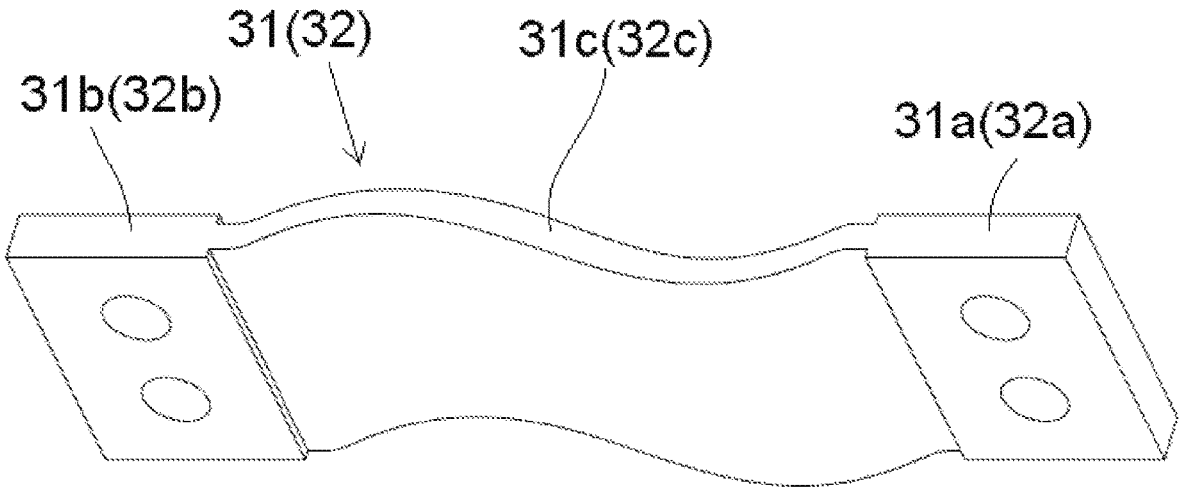
FIG. 8 is a perspective view of the flexible connection member.

The connector assembly, as shown in FIGS. 7 and 8, includes a first flexible connection member 31 and a second flexible connection member 32. The first flexible connection member 31 is adapted to electrically connect the second positive bus bar 21 to the positive conductive terminal 210. The second flexible connection member 32 is adapted to electrically connect the second negative bus bar 22 to the negative conductive terminal 220. Each of the first flexible connection member 31 and the second flexible connection member 32 includes a first plate end 31*a*, 32*a*, a second plate end 31*b*, 32*b*, and a flexible strip 31*c*, 32*c*. The first plate end 31*a*, 32*a* is adapted to be electrically connected to the positive conductive terminal 210 or the negative conductive terminal 220 by a screw. The second plate end 31*b*, 32*b* is adapted to be electrically connected to the second positive bus bar 21 or the second negative bus bar 22 by a screw. The flexible strip 31*c*, 32*c* is connected between the first plate end 31*a*, 32*a* and the second plate end 31*b*, 32*b*.

Figure 9:
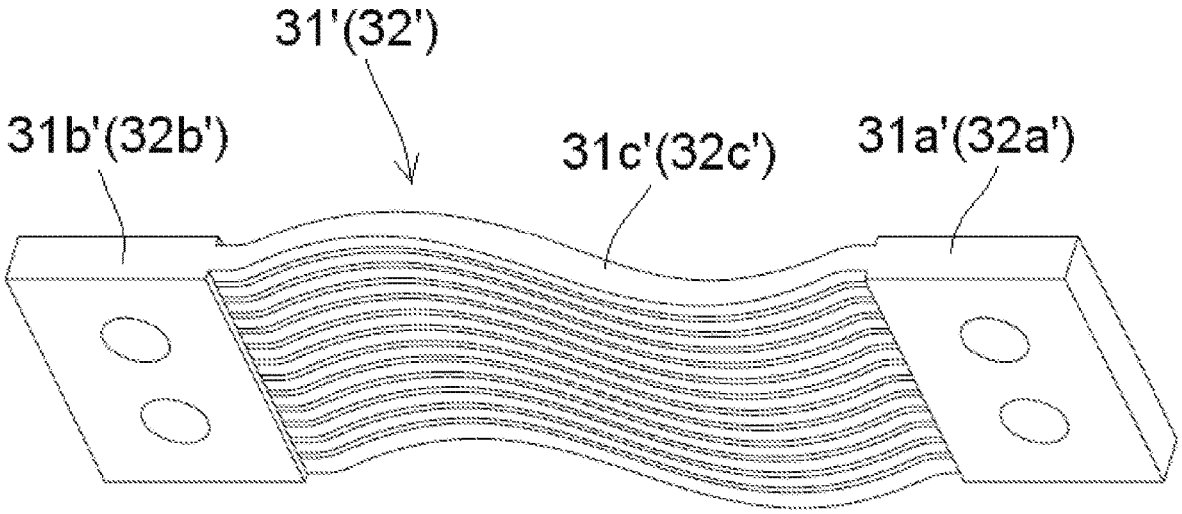
FIG. 9 is a perspective view of a flexible connection member according to another embodiment.

A first flexible connection member 31' and a second flexible connection member 32' according to another embodiment are shown in FIG. 9. Each of the first flexible connection member 31' and the second flexible connection member 32' includes a first plate end 31*a*', 32*a*', a second plate end 31*b*', 32*b*', and a flexible braided wires 31*c*', 32*c*'. The first plate end 31*a*', 32*a*' is adapted to be electrically connected to the positive conductive terminal 210 or the negative conductive terminal 220 by a screw. The second plate end 31*b*', 32*b*' is adapted to be electrically connected to the second positive bus bar 21 or the second negative bus bar 22 by a screw. The flexible braided wires 31*c*', 32*c*' are connected between the first plate end 31*a*', 32*a*' and the second plate end 31*b*', 32*b*'.

What is claimed is:

1. A connector assembly, comprising:

a bus bar plug assembly including:

(a) a first positive bus bar, (b) a first negative bus bar, and (c) an electrical isolation layer between the first positive bus bar and the first negative bus bar; and a power connector including:

(a) an insulation body having:

(1) a first receiving slot at a first side of the insulation body and adapted to receive the bus bar plug assembly, and (2) two additional receiving slots at a second side of the insulation body and separated from each other by a middle partition wall formed on the insulation body, (b) a positive conductive terminal in the insulation body having:

(1) a first end in the first receiving slot of the isolation body and adapted to electrically contact the first positive bus bar, and (2) a second end, opposite the first end of the positive conductive terminal:

(i) on a second side of the insulation body opposite the first side of the insulation body, (ii) adapted to electrically connect with the second positive bus bar, and (iii) received in one of the additional receiving slots, and (c) a negative conductive terminal in the insulation body having:

(1) a first end in the first receiving slot of the isolation body and adapted to electrically contact the first negative bus bar, and (2) a second end, opposite the first end of the negative conductive terminal:

(i) on a second side of the insulation body opposite the first side of the insulation body, (ii) adapted to electrically connect with the second negative bus bar, and (iii) received in the other of the additional receiving slots.

2. The connector assembly of claim 1, wherein the positive conductive terminal has a conductive contact point on the first end of the positive conductive terminal, the conductive contact point of the positive conductive terminal is adapted to electrically contact the first positive bus bar, and the negative conductive terminal has a conductive contact point on the first end of the negative conductive terminal, the conductive contact point of the negative conductive terminal is adapted to electrically contact the first negative bus bar.

3. The connector assembly of claim 2, wherein the power connector comprises a detection terminal disposed in the insulation body and having a detection contact point on a first end of the detection terminal, the detection contact point is adapted to electrically contact the bus bar plug assembly inserted into the slot, the detection contact point is located behind the conductive contact points of the conductive terminals and, during insertion of the bus bar plug assembly into the slot, the detection terminal is brought into electrical contact with the bus bar plug assembly only after the conductive terminals are in electrical contact with the bus bar plug assembly.

4. The connector assembly of claim 3, further comprising a power supply system configured to supply power to the bus bar plug assembly, and during insertion of the bus bar plug assembly into the power connector, the power supply system supplies power to the bus bar plug assembly only after the detection terminal is in electrical contact with the bus bar plug assembly.

5. The connector assembly of claim 4, wherein, during pulling out of the bus bar plug assembly from the power connector, the power supply system stops supplying power to the bus bar plug assembly immediately after the detection terminal is electrically disconnected from the bus bar plug assembly.

6. The connector assembly of claim 4, wherein the detection contact point of the detection terminal is adapted to be in electrical contact with the first positive bus bar or the first negative bus bar.

7. The connector assembly of claim 1, wherein the second positive bus bar is adapted to be electrically connected to the positive conductive terminal by a thread connection assembly and the second negative bus bar is adapted to be electrically connected to the negative conductive terminal by the thread connection assembly.

8. The connector assembly of claim 7, wherein the thread connection assembly includes a bolt extending through a plurality of holes formed in the second positive bus bar, the second negative bus bar, the positive conductive terminal, the negative conductive terminal, and the insulation body, and a nut screwed onto an end of the bolt.

9. The connector assembly of claim 8, wherein the bolt has an insulation coating layer to prevent the positive conductive terminal from being electrically connected to the negative conductive terminal by the bolt or the bolt has an insulation tube sleeved onto the bolt to prevent the positive conductive terminal from being electrically connected to the negative conductive terminal by the bolt.

10. The connector assembly of claim 1, further comprising a first flexible connection member adapted to electrically connect the second positive bus bar to the positive conductive terminal and a second flexible connection member adapted to electrically connect the second negative bus bar to the negative conductive terminal.

11. The connector assembly of claim 10, wherein the first flexible connection member and the second flexible connection member each include a first plate end adapted to be electrically connected to the positive conductive terminal or the negative conductive terminal, a second plate end adapted to be electrically connected to the second positive bus bar or the second negative bus bar, and a flexible strip connected between the first plate end and the second plate end.

12. The connector assembly of claim 10, wherein the first flexible connection member and the second flexible connection member each include a first plate end adapted to be electrically connected to the positive conductive terminal or the negative conductive terminal, a second plate end adapted to be electrically connected to the second positive bus bar or the second negative bus bar, and a flexible braided wire connected between the first plate end and the second plate end.

13. A power connector, comprising:

an insulation body having a slot at a first side of the insulation body;

a positive conductive terminal in the insulation body:

(a) with a first end of the positive conductive terminal in the slot of the insulation and adapted to electrically contact a first positive bus bar of a bus bar plug assembly inserted into the slot of the insulation body and a second end of the positive conductive terminal, opposite the first end, on a second side of the insulation body opposite the first side and adapted to electrically connect with a second positive bus bar, (b) having a conductive contact point on the first end of the positive conductive terminal adapted to electrically contact the first positive bus bar, and (c) including an inner metal plate and an outer metal plate laminated on the inner metal plate;

a negative conductive terminal:

(a) with a first end of the negative conductive terminal in the slot of the insulation body and adapted to electrically contact a first negative bus bar of the bus bar plug assembly and a second end of the negative conductive terminal, opposite the first end, on the second side of the insulation body, adapted to electrically connect with a second negative bus bar separated from the second positive bus bar, (b) having a conductive contact point on the first end of the negative conductive terminal adapted to electrically contact the first positive bus bar, and (c) including an inner metal plate and an outer metal plate laminated on the inner metal plate; and a detection terminal in the insulation body and having a detection contact point:

(a) on a first end of the detection terminal, (b) adapted to electrically contact the bus bar plug assembly inserted into the slot in the insulation body, (c) behind the conductive contact point of the positive conductive terminal and the conductive contact point of the negative conductive terminal, and (d) during insertion of the bus bar plug assembly into the slot in the insulation body is brought into electrical contact with the bus bar plug assembly only after the positive conductive terminal and the negative conductive terminal are in electrical contact with the bus bar plug assembly.

14. The power connector of claim 13, wherein each outer metal plate has a slot and each inner metal plate has an elastic latch that is locked into the slot of each outer metal plate, respectively, to lock the inner metal plate and the outer metal plate together.

15. The power connector of claim 14, further comprising an electrical connection member adapted to electrically connect a second end of the detection terminal to a wire in a pluggable manner.

16. The power connector of claim 15, wherein the insulation body has a connection hole adapted to be connected to an installation panel by a screw passing through the connection hole.

* * * * *